US006341425B1

(12) United States Patent
Kahle

(10) Patent No.: US 6,341,425 B1
(45) Date of Patent: Jan. 29, 2002

(54) CORDLESS ELECTRIC FILLET KNIFE

(76) Inventor: Patrick A. Kahle, N8574 County Trunck Hwy. South, Tomahawk, WI (US) 54487

( * ) Notice: Subject to any disclaimer, the term of this patent is extended or adjusted under 35 U.S.C. 154(b) by 0 days.

(21) Appl. No.: 09/629,988

(22) Filed: Jul. 31, 2000

(51) Int. Cl.[7] ..... B26B 7/00
(52) U.S. Cl. ..... 30/277.4; 30/142; 206/372
(58) Field of Search ..... 30/277.4, 123, 30/142, 147–149, 340, 535, DIG. 1; 206/372

(56) References Cited

U.S. PATENT DOCUMENTS

| | | | | |
|---|---|---|---|---|
| 2,387,765 A | * | 10/1945 | Monnet | 30/340 X |
| 3,359,637 A | * | 12/1967 | Hansen | 30/277.4 |
| 4,084,123 A | * | 4/1978 | Lineback et al. | 30/DIG. 1 |
| 4,739,242 A | * | 4/1988 | McCarty et al. | 30/DIG. 1 |
| 4,891,884 A | * | 1/1990 | Torbet | 30/277.4 |

* cited by examiner

*Primary Examiner*—Douglas D. Watts
(74) *Attorney, Agent, or Firm*—Michael I. Kroll

(57) ABSTRACT

The present invention 10 is an improved electric knife with several enhancements which make it uniquely suited for use in its intended watery environment. In case it is accidentally dropped in the water, it has several floatation chambers 54 in the handle 24 and the end cap 52 that will keep it afloat and nearly water and damage free for a reasonably long period, certainly time enough for any reasonably serious effort at retrieval to be effective. The end cap 52 is highly buoyant, having a sealed partial vacuum chamber 54. The housing has several sealed buoyant air chambers 54 in the. rearmost area to directly offset the weight of the battery pack 36. The motor housing unit also provides buoyancy and floatation by the presence of the water-resistant seal 63 at the juncture of the knife blades 42 and the handle housing 24. The critical areas around switches 44, 50 and access openings are also watertight for operating in wet or rainy conditions. Additionally, there is a light 48 in the top front area of the handle with its nearby water-sealed 56 switch 50 for illuminating the work area when operating under night or low light conditions. The present invention comes with a carrying case 18 and many additional components: a recharging unit 34 for recharging the power pac 36, a reenergizer 38 for charging the power pac 36 and operating under AC simultaneously, a spare power pac 36, 2 different sized interchangeable blade sets 26, a blade cover 28, DC 12 volt power cord 30, AC power cord 32 and the fillet knife housing unit.

15 Claims, 9 Drawing Sheets

CORDLESS ELECTRIC FILLET KNIFE

BACKGROUND OF THE INVENTION

1. Field of the Invention

The present invention relates generally to electric knives and, more specifically, to cordless electric fillet knives. The field of electric knives is well represented in prior art. Several methods for producing cutting are known: using either one blade or a set of two blades with serrated edges joined together side-by-side can be made to cut using electromechanical means to produce a continuous series of back and forth repetitive axial movements of the blade with respect to the blade handle. Variations exist within this class of movement for the two blade configuration wherein one blade is fixed to the handle and the other is secured to the fixed blade in such a way as to allow it to slide in a limited displacement axial motion by the action of a motor to which the movable blade is connected by any of a variety of means. Another method is to connect both blades to each other as in the previous example and, in turn, to a electromechanical means of producing a reciprocating movement of the blades against one another. This axial movement produces either a slicing or shearing action for the one or two blade configuration devices respectively. Various alternative means for producing this type of motion have been protected as well as additional features such as offset blades for cutting inside recesses. Cordless and battery operated devices are also well known and well represented in this field. However, in applying this type of power source to fishing knives and specifically to filleting knives, no known example of prior art has dealt with the attendant problems of cordless day and night operation of electromechanical actuated filleting knives around and, on the occasion of accident, within a water environment.

The present invention, the Cordless Electric Fillet Knife, is the only known device of its kind to successfully deal with this problem. The present invention is basically a standard electric knife with several built-in enhancements which make it uniquely suited for use in its intended watery environment. In case it is accidentally dropped in the water, it has several floatation chambers in the handle and the end cap that will keep it afloat and nearly waterfree for a long time, certainly time enough for any reasonably serious effort at retrieval to be effective without incurring any water damage whatsoever. The only area not completely watertight is at the juncture of the knife and handle, which is water-resistant. The critical areas around switches and access openings are watertight. There is also a light in the top front area of the handle for night or low visibility conditions. The Cordless Electric Fillet Knife is just what the inveterate fisherman has been waiting for.

2. Description of the Prior Art

There are other electric knife devices designed for culinary application. Typical of these is U.S. Pat. No. 4,593,466 issued to William J O'Brien on Jun. 10, 1986.

Another patent was issued to Robert B. Ruston, Sr. on Dec. 8, 1997 as U.S. Pat. No. 4,711,030. Yet another U.S. Pat. No. 4,891,884 was issued to Philip Torbet on Jan. 9, 1990 and still yet another was issued on May 1, 1990 to George A. Moore as U.S. Pat. No. 4,920,612.

Another patent was issued to Richard B. Maxcy on Apr. 4, 1995 as U.S. Pat. No. 5,402,575. Yet another U.S. Pat. No. 5,845,404 was issued to Norman C. Jeffcoat on Dec. 8, 1998. Another was issued to Don R. McCloskey on Dec. 2, 1986 as U.S. Pat. No. Des. 286,969 and still yet another was issued on Nov. 20, 1990 to Jean-Louis Barrault as U.S. Pat. No. Des. 312,192. Another patent was issued on Dec. 30, 1997 to Amir M. Neshat as U.S. Pat. No. Des. 388,285 and still another was issued to Shigehiro Uemura, et al. On Jul. 6, 1999 as U.S. Pat. No. Des. 411,785.

U.S. Pat. No. 4,593,466

Inventor: William J O'Brien

Issued: Jun. 10, 1986

An electric knife of the kind having an elongated handle that serves as a container for a driving electric motor, a pair of blades projecting in an axial direction from the handle, the blades being releasably secured to a drive connected to the motor in such a manner that the blades are reciprocated so as to move in sliding contact with each other the blades having serrated cutting edges, which is characterized by the feature that the line containing the serrated cutting edge of each of the blades is off set from the axis of the handle in such a manner that if the line is extended in the direction of the handle there is a space between the line and any adjacent portion of the handle.

U.S. Pat. No. 4,711,030

Inventor: Robert B. Ruston

Issued: Dec. 8, 1997

A portable, hand-held electric knife having dual cutting blades is powered by a DC electric motor which draws its operating current from a remote storage battery. The cutting blades are mechanically coupled to the armature shaft of the DC electric motor by a gear assembly in which a pair of bevel gears are mounted for free rotation on a support shaft and are engaged by a beveled pinion gear attached to the rotor armature. Each blade is movably coupled to a selected bevel gear by a pin. In response to rotation of the drive pinion, the beveled gears are driven in counter-rotating motion. As the driven gears rotate, the blades are extended and retracted in side-by-side relation. A fulcrum shaft is received through aligned slots formed in the blades. Linear reciprocating movement of the blades relative to each other is stabilized and arcuate reciprocating movement of the coupled blades is effected as the blades pivot about the fulcrum shaft. According to this arrangement, the coupled blades undergo simultaneous linear reciprocal movement along parallel paths of extension and retraction, and arcuate reciprocal movement about a path transverse thereto.

U.S. Pat. No. 4,891,884

Inventor: Philip Torbet

Issued: Jan. 9, 1990

A light weight hand holdable appliance having a plurality of blade-like components for slicing peeling and the like. The appliance preferably is cordless and rechargeable and has a handle assembly within which is a high speed motor, a reciprocating mechanism and an interconnecting gear reduction and cam means for translating the high speed rotation of the motor to a powerful reciprocating stroke of the mechanism. The blade-like components include a knife having a thin single blade, particularly suitable for slicing, and a peeler having a thin single peeling blade and a guide spaced therefrom to facilitate peeling.

U.S. Pat. No. 4,920,612

Inventor: George A. Moore

Issued: May 1, 1990

A knife for filleting fish includes a generally flat cutting blade disposed in a first plane and having a proximal end and a distal end. A generally flat boning blade is disposed in a second plane and has a proximal end, a distal end and a cutting edge. The proximal end of the boning blade is attached to the distal end of the cutting blade in a manner such that the first plane of the cutting blade and the second plane of the boning blade are generally normal to one another. A handle is attached to the proximal end of the cutting blade and the knife thereby permits cutting of a fish along either of two cutting axes without substantially changing the orientation of the knife with respect to the fish.

Several embodiments are disclosed.

U.S. Pat. No. 5,402,575

Inventor: Richard B. Maxcy

Issued: Apr. 4, 1995

The folding knife has a handle provided with a blade support the intermediate part thereof being of less width than the first and second end. A lengthwise slot in the front edge extends through the first end to provide a fork and the bottom of the slot is so spaced from the back edge of the handle to provide a section having a chamber opening through the sides of the section when one of the side covers of the handle is removed. A passageway from the chamber opens through the second end of the blade support and is closed by a lens. A battery and a switch assembly fit in the chamber with the switch assembly provided with a tubular lamp socket which, when the battery and assembly are held by a grounding spring in an operative position extends through the socket. The assembly includes a two part circuit closing push button with one part extending through and held by the back edge of the handle and the other part incorporated in the assembly. The blade is pivotally connected to the fork. Each pair of springs is anchored to a side of the slot to accommodate the blade between them when the knife is closed and each is supported by the blade pivot but is moveable in directions normal thereto and has a lug extending laterally to ride on the cam surfaces of the attached end of the blade.

U.S. Pat. No. 5,845,404

Inventor: Norman C. Jeffcoat

Issued: Dec. 8, 1998

An ergonornically-designed, multipurpose tool including a handle, a blade with a shank and a tip, and a fastener for attaching the handle to the shank. The blade has a curved outer edge extending substantially from the shank to the tip, with, preferably, an integrally-formed gut hook positioned near the shank and opening toward the tip. A portion of the outer edge is sharpened to form a cutting edge. The fastener is user-operable for moving the blade from a first operating position where it opposes the handle to at least one next operating position, for example, extending forward of the handle for use as a hatchet. Regardless of the position of the blade, the user can control the length and direction of a cut by pivoting the wrist alone, the forearm at the elbow, the entire arm from the hand gripping the knife to the shoulder, by pushing or pulling the knife with the hand and forearm, or any combination thereof Range of motion, dexterity and control of the cutting edge are thereby improved, with greater comfort than is possible with a conventional knife. The handle may include a compartment for storing one or more additional instruments for use therewith, such as a saw, a serrated blade, an ice pick, a fish hook, a knife blade, a file, a wrench, and a screw driver.

U.S. Pat. No. Des. 286,969

Inventor: Don R. McCloskey

Issued: Dec. 2, 1986

This United States Patent discloses an ornamental design for a cordless electric knife housing as illustrated in the drawings of the patent.

U.S. Pat. No. Des. 312,192

Inventor: Jean-Louis Barrault

Issued: Nov. 20, 1990

This United States Patent discloses an ornamental design for a cordless electric knife handle as illustrated in the drawings of the patent.

U.S. Pat. No. Des. 388,285

Inventor: Amir M. Neshat

Issued: Dec. 30, 1997

This United States Patent discloses an ornamental design for a electric fillet knife handle as illustrated in the drawings of the patent.

U.S. Pat. No. Des. 411,785

Inventor: Shigehiro Uemura

Issued: Jul. 6, 1999

This United States Patent discloses an ornamental design for a electric knife handle, as illustrated in the drawings of the patent.

While these electric knives may be suitable for the purposes for which they were designed, they would not be as suitable for the purposes of the present invention, as hereinafter described.

SUMMARY OF THE PRESENT INVENTION

The present invention is an improved electric knife with several enhancements which make it uniquely suited for use in its intended watery environment. In case it is accidentally dropped in the water, it has several floatation chambers in the handle and the end cap that will keep it afloat and nearly water and damage free for a reasonably long period, certainly time enough for any reasonably serious effort at retrieval to be effective. The end cap is highly buoyant, having a sealed partial vacuum chamber. The housing has several sealed buoyant air chambers in the rearmost area to directly offset the weight of the detachable battery pack. The motor housing unit also provides buoyancy and floatation by the presence of the water-resistant seal at the juncture of the knife blades and the handle housing. The critical areas around switches and access openings are also watertight for operating in wet or rainy conditions. Additionally, there is a light in the top front area of the handle with its nearby water-sealed switch for illuminating the work area when operating under night or low light conditions. The present invention comes with a carrying case and many additional components: a recharging unit for recharging the power pac, a reenergizer for charging the power pac and operating under AC simultaneously, a spare power pac, two different sized interchangeable blade sets, a blade cover, DC 12-volt power cord, AC power cord and the fillet knife housing unit.

A primary object of the present invention is to provide a fillet knife that would be especially adapted for use in a watery environment.

Another object of the present invention is to provide a rechargeable electromechanically operated fillet knife that would be especially adapted for use in a watery environment.

Yet another object of the present invention is to provide a rechargeable electromechanically operated fillet knife that would be especially adapted for use in a watery environment, including having floatation in case of an accidental drop in the water.

Still yet another object of the present invention is to provide a rechargeable electromechanically operated fillet knife that would be especially adapted for use in a watery environment, including being water resistant for operation under wet or rainy conditions.

Yet another object of the present invention is to provide a rechargeable electromechanically operated fillet knife that would be especially adapted for use in a watery environment, including having a light for operation under low light or nighttime conditions.

Yet even another object of the present invention is to provide a rechargeable electromechanically operated fillet knife that would be especially adapted for use in a watery environment, including having a means for recharging the removable power pac unit.

Yet another object of the present invention is to provide a rechargeable electromechanically operated fillet knife that would be especially adapted for use in a watery environment, including having a means for recharging the power pac unit while continuing to operate on AC power.

Additional objects of the present invention will appear as the description proceeds.

The present invention overcomes the shortcomings of the prior art by providing the only known device of its kind to deal successfully with this problem. The present invention, the Cordless Electric Fillet Knife, is basically a standard electric knife with several built-in enhancements which make it uniquely suited for use in its intended watery environment. In case it is accidentally dropped in the water, it has several floatation chambers in the handle and the end cap that will keep it afloat and nearly water and damage free for a reasonably long period, certainly time enough for any reasonably serious effort at retrieval to be effective. The end cap is highly buoyant, having a sealed partial vacuum chamber. The housing has several sealed buoyant air chambers in the rearmost area to directly offset the weight of the recharging unit. The motor housing unit also provides buoyancy and floatation by the presence of the water-resistant seal at the juncture of the knife blades and the handle housing. The critical areas around switches and access openings are also watertight for operating in wet or rainy conditions. Additionally, there is a light in the top front area of the handle with its nearby water-sealed switch for illuminating the work area when operating under night or low light conditions. The present invention comes with a carrying case and many additional components: a recharging unit for recharging the power pac, a reenergizer for charging the power pac and operating under AC simultaneously, a spare power pac, 2 different sized interchangeable blade sets, a blade cover, DC 12 volt power cord, AC power cord and of course, the fillet knife housing unit. The Cordless Electric Fillet Knife is just what the inveterate fisherman has been waiting for.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

Figure 1:
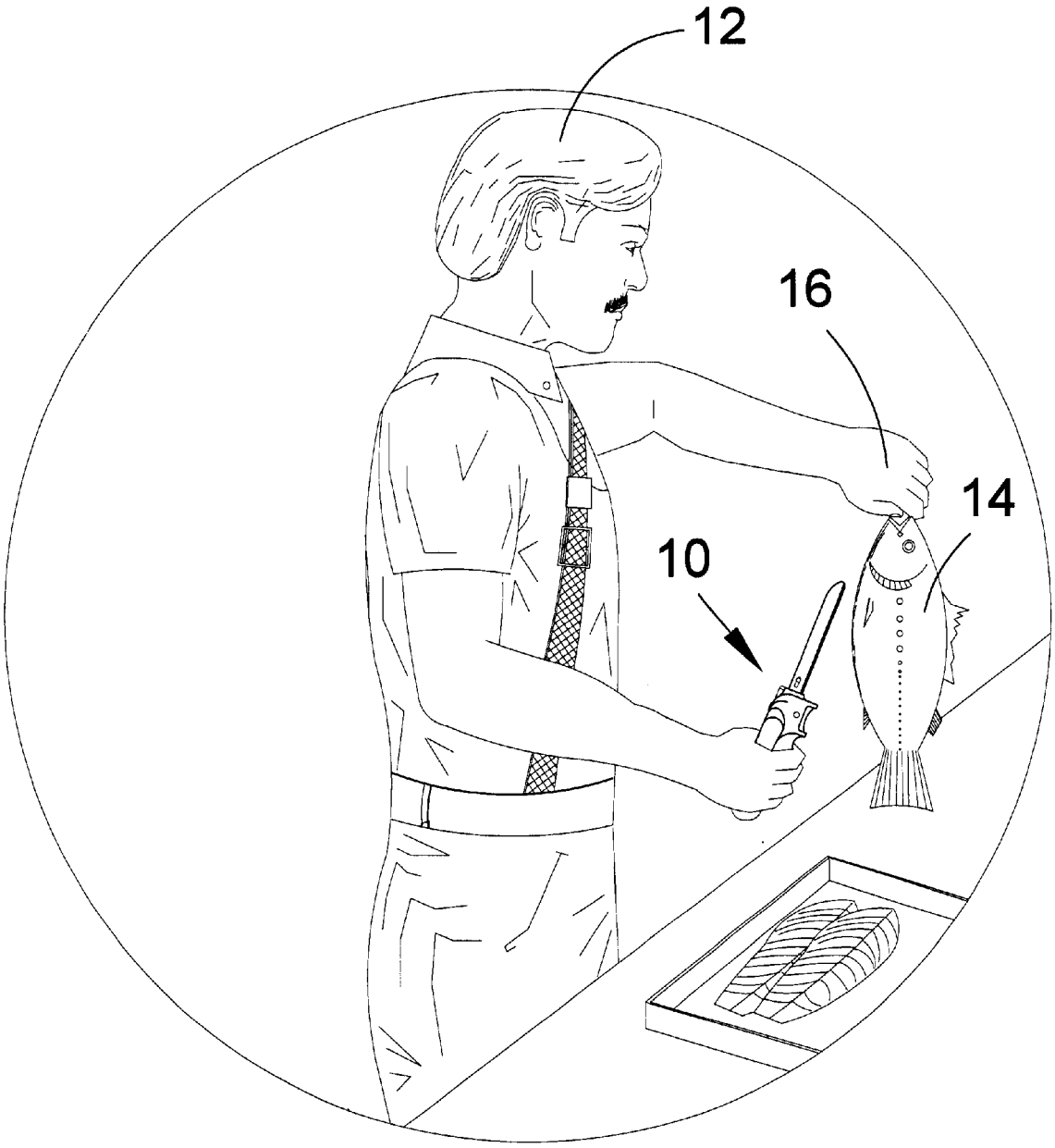
FIG. 1 is a perspective view of a person using the present invention, the Cordless Electric Fillet Knife.

LIST OF REFERENCE NUMERALS regard to reference numerals used, the following numbering is used throughout the drawings.

10 present invention
12 user
14 fish
16 hand
18 carrying case
20 top
22 hinges
24 handle
26 spare blades
28 blade protector
30 12 VDC cord
32 110 VAC cord
34 recharger
36 rechargeable power pac

38 re-energizer unit
40 recharger release
42 blades
44 on/off switch
46 switch lock
48 light
50 light switch
52 end cap
54 flotation chamber
56 watertight seal
58 motor
60 electrical plug connecting means
62 electrical wire
63 water resistant seal
64 case handle
66 case latch
68 fuill charge light
70 low charge light
72 socket
74 reciprocating arm
76 attachment means
78 apertures
80 attachment means

DESCRIPTION OF THE PREFERRED EMBODIMENT(S)

In order that the invention may be more fully understood, it will now be described, by way of example, with reference to the accompanying drawings in which FIGS. 1 through 9 illustrate the present invention being a cordless electric fillet knife.

Turning to FIG. 1, shown therein is a perspective view of a person 12 using the present invention 10, being a cordless electric fillet knife to fillet a fish 14 which the user is holding in his hand 16.

Figure 2:
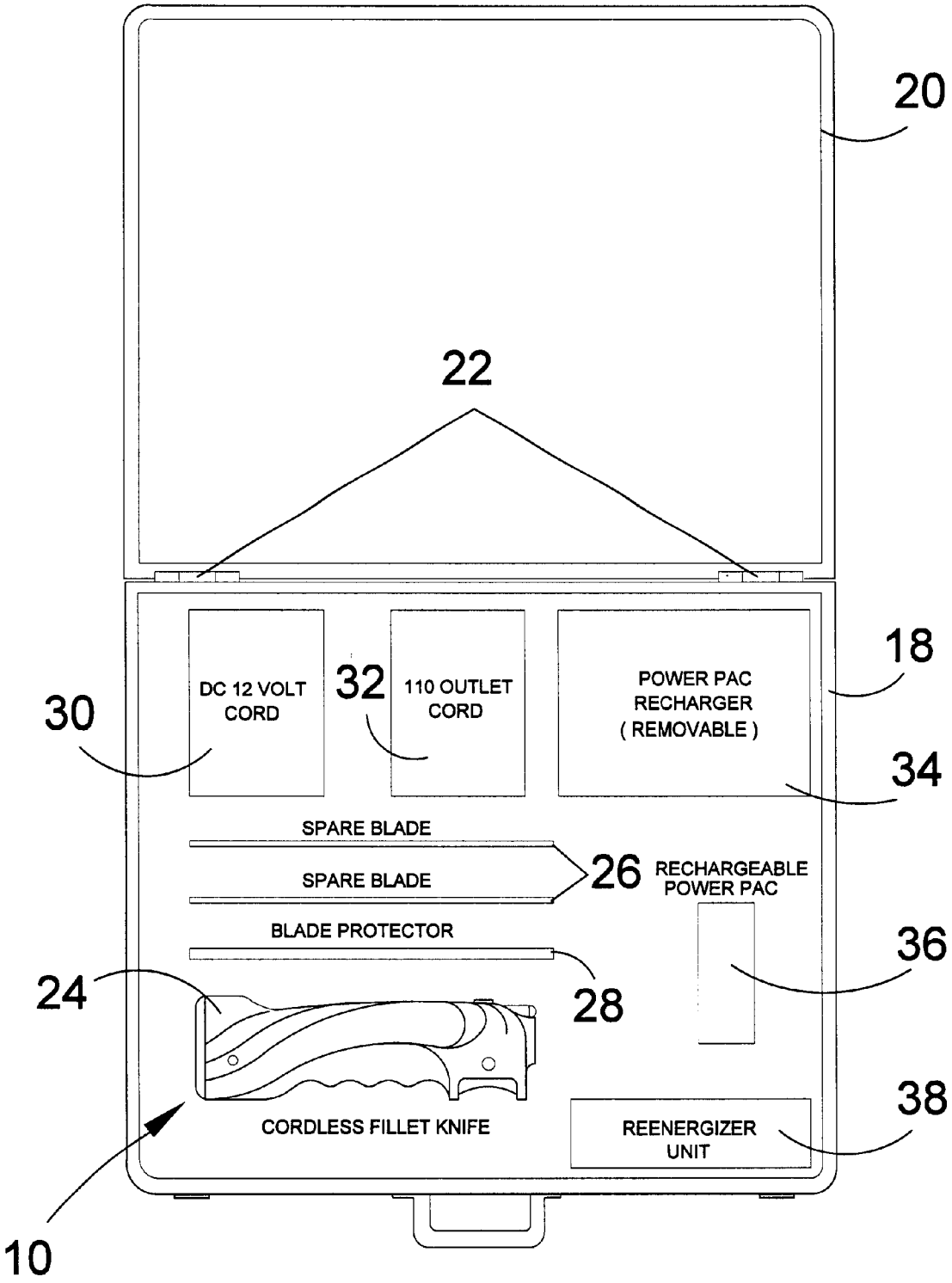
FIG. 2 is a top view of the carrying case for the present invention, the Cordless Electric Fillet Knife, with all its components stowed therein.

Turning to FIG. 2, shown therein is a top view of the carrying case 18 for the present invention 10 with all its components stowed therein. The case 18 has a top 20 connected by hinges 22 to the case base. Shown is the knife handle 24, a pair of spare blades 26, a blade protector 28, a 12-volt DC power cord 30, a 110-V AC outlet power cord 32, a charger 34, a rechargeable power pac 36, and a reenergizer unit 38.

Figure 3:
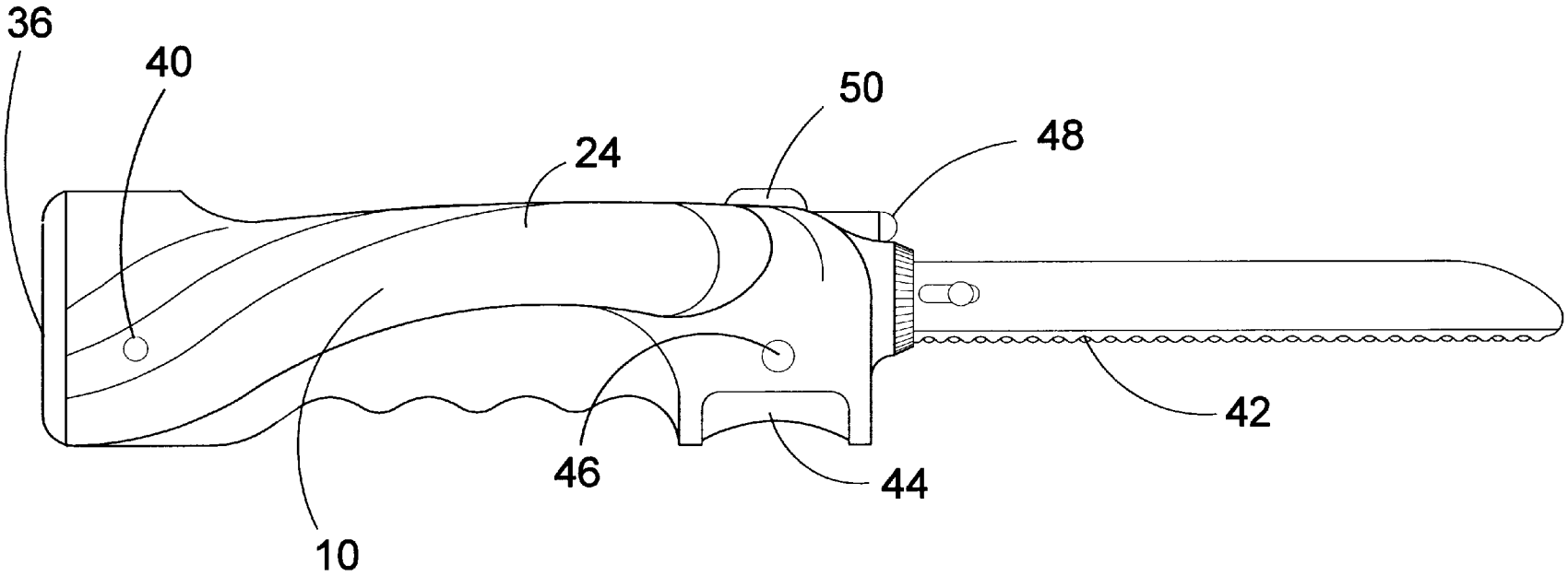
FIG. 3 is a side view of the present invention, the Cordless Electric Fillet Knife, indicating the different features.

Turning to FIG. 3, shown therein is a side view of the present invention 10. Shown is the handle 24 having a built-in rechargeable power pac 36 having a rechargeable battery release button 40. Also shown are the interchargeable dual serrated blades 42 with knife trigger on/off switch 44, switch button lock 46, along with the light 48 and light on/off switch 50.

Figure 4:
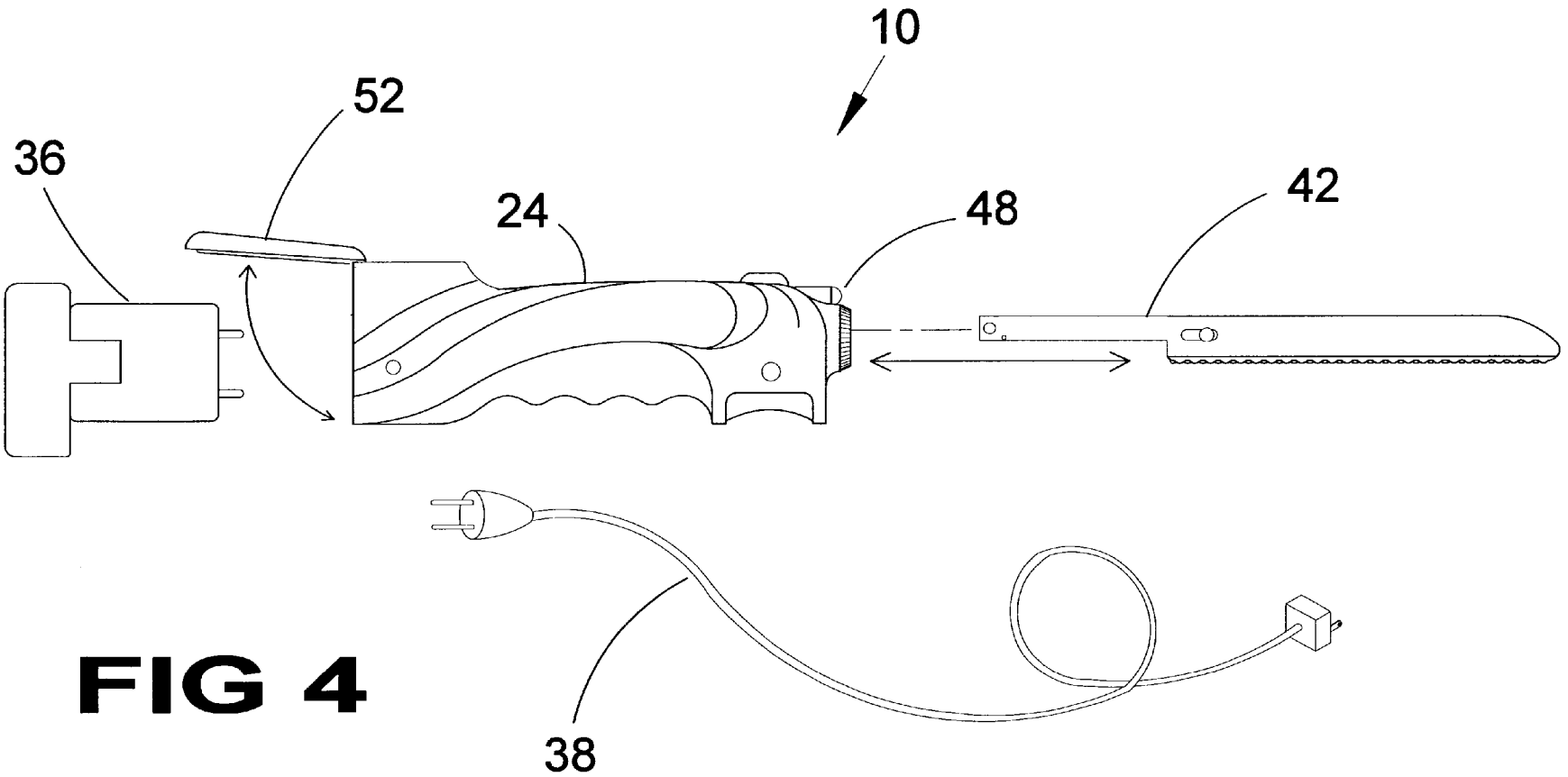
FIG. 4 is an exploded view showing the separated components of the present invention, the Cordless Electric Fillet Knife.

Turning to FIG. 4, shown therein is an exploded view showing the separated components of the present invention 10. Shown is the handle 24 having an end cap 52 thereon distal to the fillet blades 42 having a light 48 and detachable power pac 36. Also shown is the reenergizer unit 38 which recharges the power pac 36 while not in use by keeping the fillet knife 10 plugged in.

Figure 5:
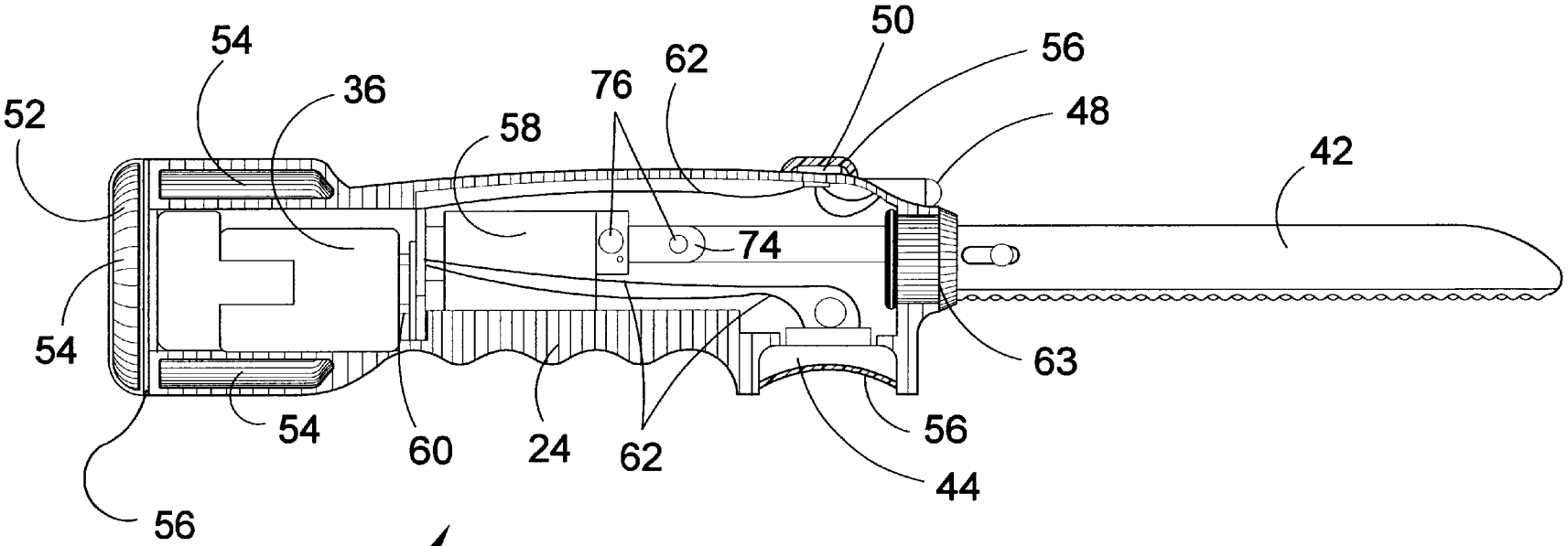
FIG. 5 is a sectional view of the present invention, the Cordless Electric Fillet Knife, showing its internal floatation and water-sealing features.

Turning to FIG. 5, shown therein is a sectional view of the present invention 10 showing its internal floatation and water-sealing features. Shown is the handle 24 having multiple flotation chambers 54 therein with a high flotation end cap 52 attached using a watertight seal 56. Also shown are the motor 58 with reciprocating arm 74 with power pac 36 connected by electrical plug means 60 and electrical wiring 62. Also shown are a light 48 with switch 50 having a watertight seal 56 along with the trigger switch 44 with seal 56 and water resistant seal 64 on the front of handle 24. The motor 58 and arm 74 have means 76 for attaching the blades 42.

Figure 6:
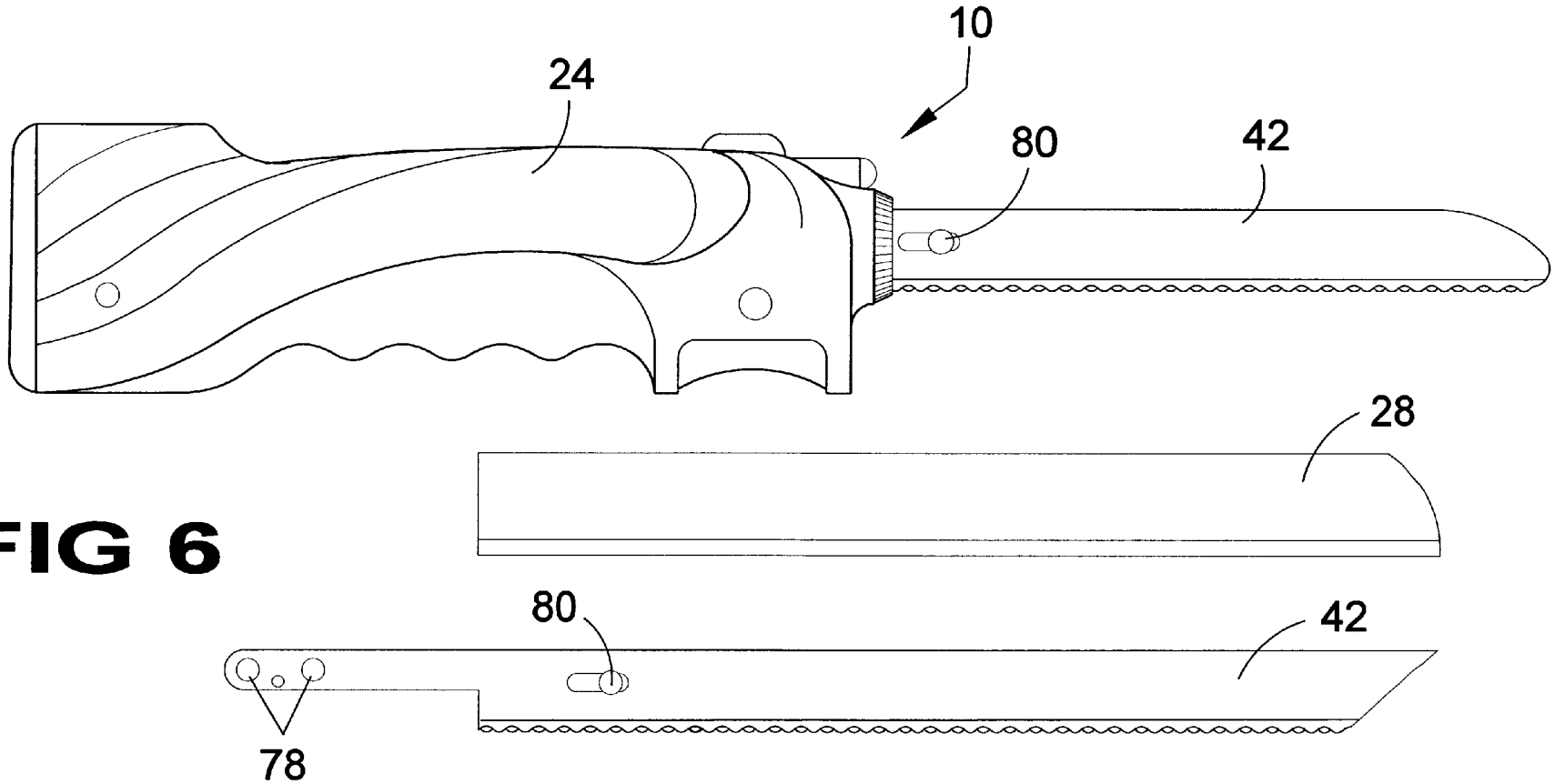
FIG. 6 is a side view of the present invention, the Cordless Electric Fillet Knife, showing the interchangeable blades and blade protector.

Turning to FIG. 6, shown therein is a side view of the present invention showing the handle 24, interchangeable blades 42 being a 7-inch blade and a 9-inch blade and a blade protector 28. Apertures 78 are shown for mating with means 76 (not shown, see FIG. 5). Also shown are attachment means 80 for connecting blades 42 together.

Figure 7:
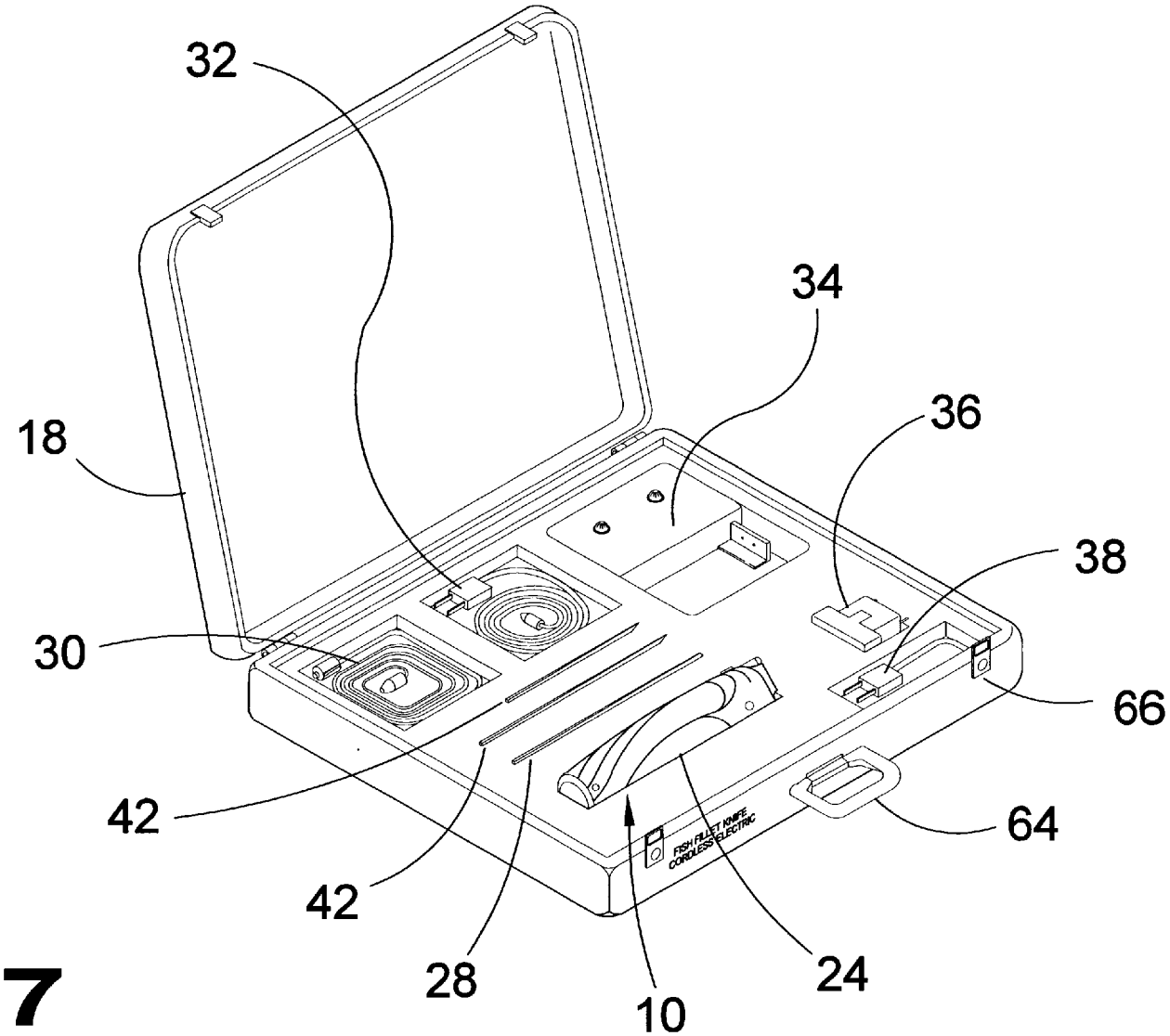
FIG. 7 is a perspective view of the carrying case for the present invention, the Cordless Electric Fillet Knife, with all its components stowed therein.

Turning to FIG. 7, shown therein is a perspective view of the carrying case 18 with handle 64 and snap latches 66 for the present 10 with all its components stowed therein. Shown are the knife handle 24, with blades 42 and blade protector 28 align with 12 VDC cord 30, 110-VAC cord 32, removable power pac recharger 34, spare rechargeable power pac, and reenergizer unit 38.

Figure 8:
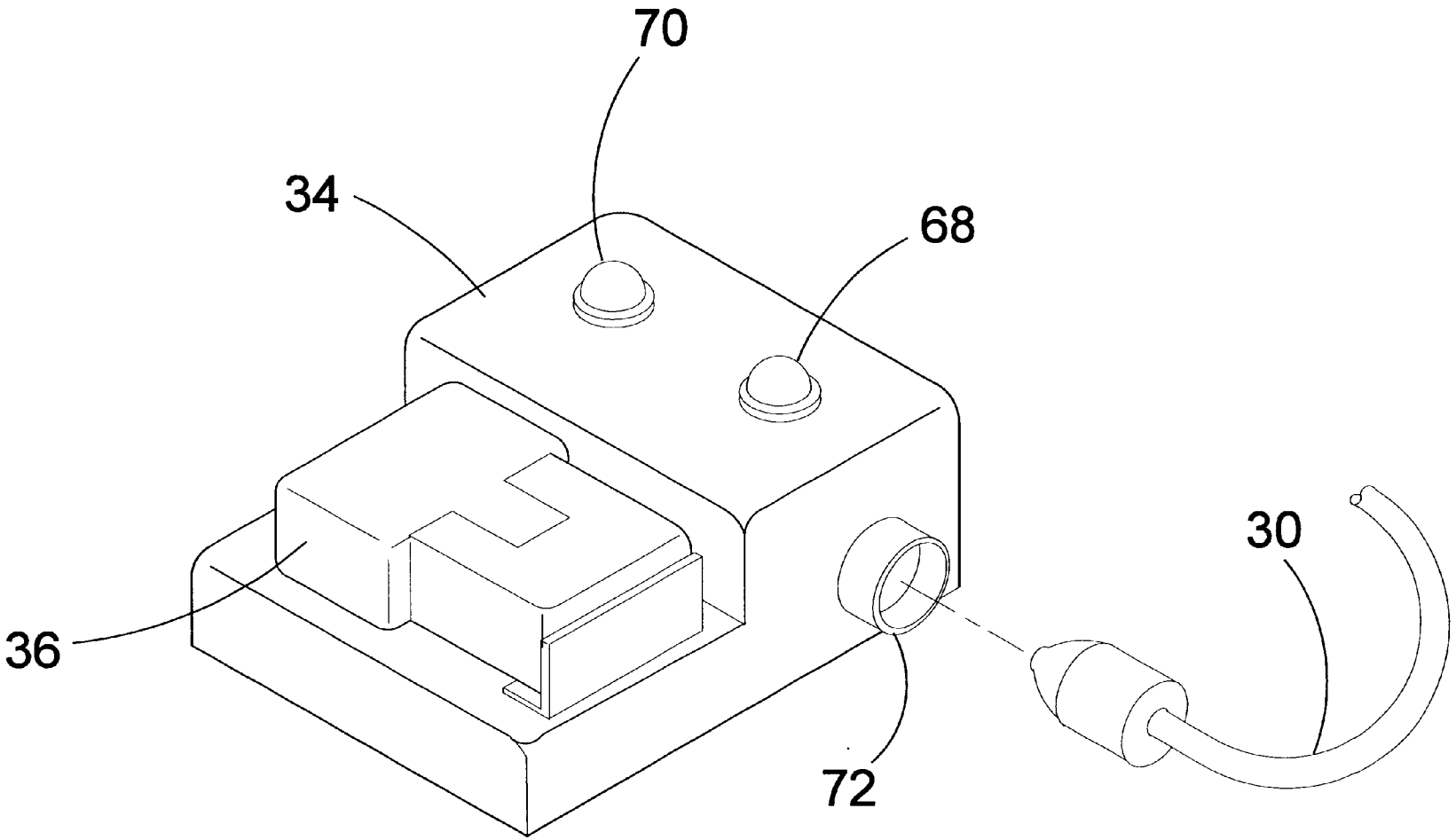
FIG. 8 is a perspective view of the recharging unit of the present invention, the Cordless Electric Fillet Knife, with the rechargeable power pac in position within the recharging unit for recharging.

Turning to FIG. 8, shown therein is a perspective view of the recharging unit 34 of the present invention with the rechargeable power pac 36 in position within the recharging unit for recharging. Shown are a full charge indicator light 68 and low charge indicator light 70 along with a power cord 30 and cord socket 72.

Figure 9:
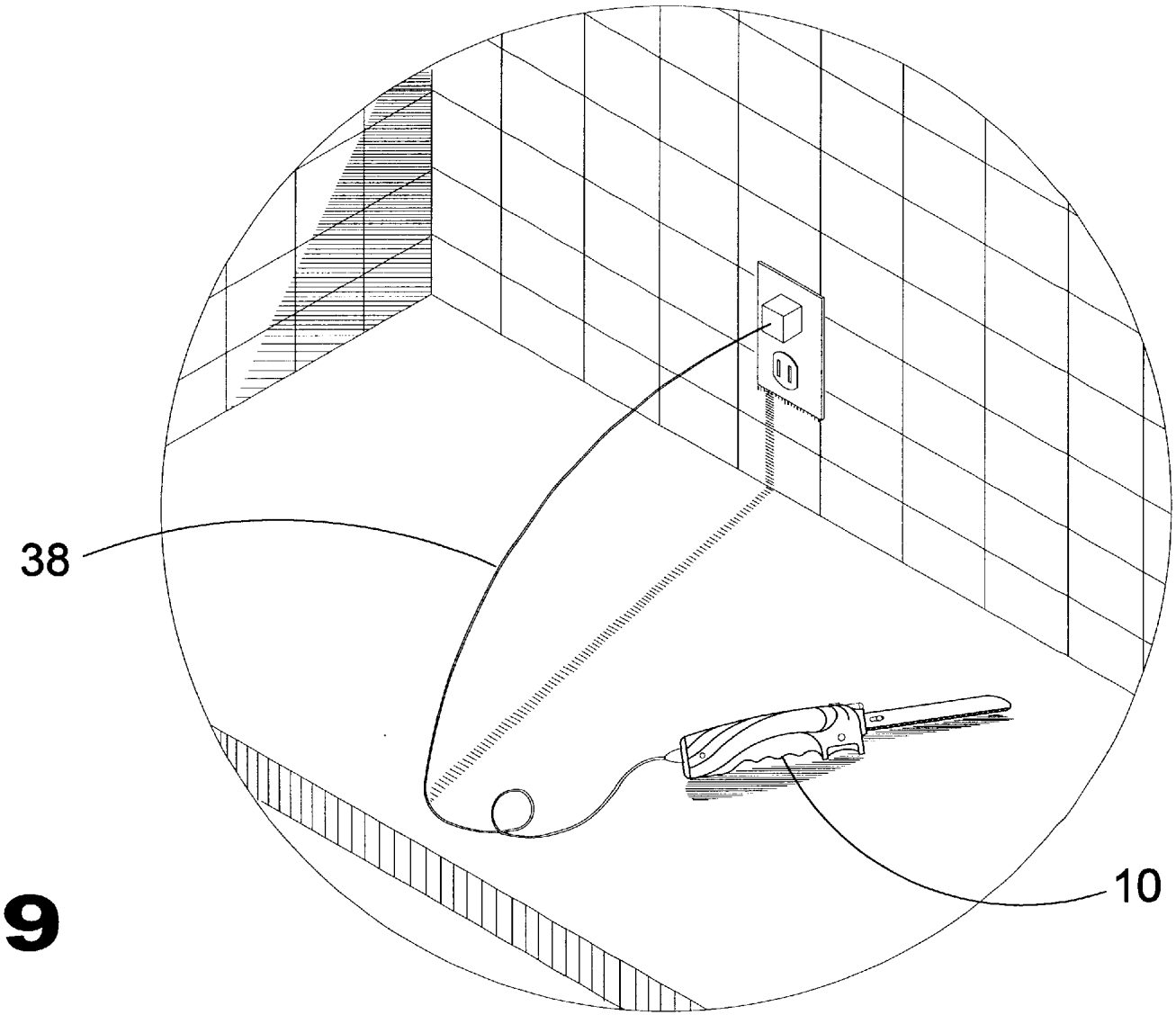
FIG. 9 is a perspective view of the present invention, the Cordless Electric Fillet Knife, using the reenergizer unit to keep operating under AC power while attaining and maintaining a fully charged power pac.

Turning to FIG. 9, shown therein is a perspective view of the present invention 10 using the reenergizer unit 38 which is a separate recharger to keep operating under AC power while attaining and maintaining a fully charged power pac.

What is claimed to be new and desired to be protected by letters patent is set forth in the appended claims:

I claim:

1. In a hand-held electric knife having a handle, dual cutting blades being joined together for cooperating side-by-side operation, a D.C. electric motor, the electric motor being joined to the dual cutting blades by means for producing repetitive axial movements of each blade with respect to each other and the handle, the electric motor having a switch disposed on the handle for operation by a finger of the user, the improvement comprising:

a) a removable battery pack, said battery pack furnishing the energy for operation of the D.C. electric motor;

b) a plurality of flotation chambers disposed in the handle;

c) a light disposed on the front of the handle; and, d) a switch means disposed on the handle for controlling said light.

2. The apparatus of claim 1, wherein said battery pack is rechargeable.

3. The apparatus of claim 1, further comprising an end cap disposed on the handle distal of the blade through which said battery pack is removed.

4. The apparatus of claim 3, said end cap further comprising a flotation chamber.

5. The apparatus of claim 4, further comprising a first watertight seal disposed between said end cap and the handle.

6. The apparatus of claim 1, further comprising a second watertight seal disposed over said switch means.

7. The apparatus of claim 6, wherein said second watertight seal is made of flexible material.

8. The apparatus of claim 1, fuirther comprising a third watertight seal disposed over the switch disposed on the handle for receiving the finger of the user.

9. The apparatus of claim 8, wherein said third watertight seal is made of flexible material.

10. The apparatus of claim 1, further comprising a water resistant seal disposed between the dual cutting blades and the handle.

11. The apparatus of claim 2, further comprising means for re-energizing said battery pack while said battery pack is contained in the handle.

12. A portable electric fillet knife kit, comprising:

a) a case, having a lower base for housing the fillet knife and accessories, said case having a hinged top;

b) a latch for connecting said top to said lower base;

c) a fillet knife housing containing a hand-held electric knife having a handle, dual cutting blades being joined together for cooperating side-by-side operation, a D.C. electric motor, the electric motor being joined to the dual cutting blades by means for producing repetitive axial movements of each blade with respect to each other and the handle, the electric motor having a switch disposed on the handle for operation by a finger of the user;

d) a plurality of blades for said fillet knife;

e) a protective cover for said blades;

f) a removable battery pack; and, g) a battery recharger for recharging said battery pack.

13. The apparatus of claim 12, further comprising means for re-energizing said battery pack said means for use with said battery pack while said battery pack is disposed in said housing.

14. The apparatus of claim 13, further comprising a 12 volt DC electric cord for use with said fillet knife.

15. The apparatus of claim 14, further comprising a 110 volt AC electric cord for use with said battery charger.

* * * * *